US006702541B1

(12) United States Patent
Lee

(10) Patent No.: US 6,702,541 B1
(45) Date of Patent: Mar. 9, 2004

(54) PALLETLESS RACK-TYPE PARKING SYSTEM WITH STACKER CRANE

(76) Inventor: Wan Young Lee, 103-202 Gwanak Hyeondae Apt., 1000 Bongcheon 3-dong, Gwanak-gu, Seoul 151-755 (KR)

( * ) Notice: Subject to any disclaimer, the term of this patent is extended or adjusted under 35 U.S.C. 154(b) by 0 days.

(21) Appl. No.: 10/382,740

(22) Filed: Mar. 5, 2003

(30) Foreign Application Priority Data

Sep. 13, 2002 (KR) ..... 2002-0055712

(51) Int. Cl.[7] ..... E04H 6/00
(52) U.S. Cl. ..... 414/253; 414/254
(58) Field of Search ..... 414/253, 254

(56) References Cited

U.S. PATENT DOCUMENTS

| | | | | | |
|---|---|---|---|---|---|
| 3,792,785 | A | | 2/1974 | Weir | 214/16.4 |
| 5,108,254 | A | * | 4/1992 | Go | 414/807 |
| 5,111,931 | A | | 5/1992 | Gombos et al. | 206/83.5 |
| 5,116,182 | A | * | 5/1992 | Lin | 414/254 |
| 5,330,305 | A | * | 7/1994 | Go | 414/254 |
| 5,505,573 | A | * | 4/1996 | Han | 414/254 |
| 5,915,907 | A | * | 6/1999 | Yatou et al. | 414/254 |
| 6,042,321 | A | | 3/2000 | Labell | 414/276 |
| 6,129,497 | A | * | 10/2000 | Woodson et al. | 414/277 |
| 6,315,513 | B1 | | 11/2001 | Harukawa et al. | 414/286 |
| 6,332,743 | B1 | * | 12/2001 | Park et al. | 414/234 |

FOREIGN PATENT DOCUMENTS

| | | |
|---|---|---|
| GB | 946580 | 1/1964 |
| WO | WO 92/21565 | 12/1992 |

* cited by examiner

*Primary Examiner*—Richard Ridley
(74) *Attorney, Agent, or Firm*—Sheridan Ross PC

(57) ABSTRACT

A palletless rack-type parking system with a stacker crane comprises a plurality of racks each having a plurality of parking spaces in a lattice form and arranged on a support surface to be spaced apart from each another at a regular interval; a plurality of storage fork bars each including a first projection tab projected from a predetermined portion of a lower surface thereof to have a predetermined height and horizontally mounted on an upper surface of a first support beam in a regular interval through the first projection tap to cross the support beam in a right angle, at least one end of which is projected longer from the support beam of the rack in a beam form; a transporting fork including a plurality of transporting fork bars each having a second projection tap projected from a predetermined portion of a lower surface thereof to have a predetermined height and a second support beam arranged to cross the storage fork bar in a right angle and for supporting the second projecting tap facing its lower surface; and a stacker crane installed in each vertical space between two neighboring racks and operable in more than two-axial directions of leftward, rightward, upward and downward with the transporting fork being mounted thereon, thereby enabling the transporting fork to be moved upward or downward within a minimum allowance that the vehicle is not interfered with transporting fork bars or storage fork bars of the transporting fork.

23 Claims, 14 Drawing Sheets

PALLETLESS RACK-TYPE PARKING SYSTEM WITH STACKER CRANE

BACKGROUND OF THE INVENTION

1. Field of the Invention

The present invention relates, in general, to a parking system for storing a plurality of vehicles in a limited area, and more particularly, to a palletless rack-type parking for quickly, precisely and safely taking a vehicle into and/or taking it out of the parking space system using a stacker crane operable in more than two axial directions to a rack unit having a plurality of parking spaces without a separate vehicle loading pallet.

2. Description of the Prior Art

In recent years, a rapid increase of vehicles causes the absolute lacking phenomena of parking places, so it becomes serious social problems of raising the difficulty of parking following by the traffic congestion and the environmental pollution. Particularly, the problem of parking places becomes more serious in very busy midtowns due to limited parking places, so it leads to frequent illegal parking, which blocks a traffic flow resulting in the terrible traffic jams.

In an effort to solve such problems of illegal parking and a shortage of parking places in busy cities, there have been attempted a variety of solutions, for example, strengthening of parking regulations and enacting of ordinances which oblige building owners to establish parking places in or around their buildings. However, the expansion of parking places couldn't help having a limitation due to the difficult of securing lands in busy cities.

Therefore, a variety of schemes have been studied in search of a better solution for effectively parking many vehicles on limited areas. As a result of such studies, several parking systems have been proposed and widely used to store vehicles in floors in parking spaces using a mechanical drive unit.

Such conventional parking systems are generally classified into several types such as a circulation-type system, a puzzle-type system, an elevator-type system, etc., in accordance with a drive system. Each of the circulation-type and puzzle-type systems must store a vehicle on its exclusive parking pallet defining a parking space thereon and follow the movement of a plurality of vehicles at the same time of loading or unloading one vehicle into or it out of a parking space, so the demand for such systems falls off nowadays. In place of the circulation-type and puzzle-type systems, elevator-type parking systems have been most widely used, which can simply enter a vehicle into a designated parking space or delivery it therefrom.

An example of a conventional elevator-type parking system is disclosed in Korean Patent No. 0271061 which comprises an elevator for carrying a vehicle loaded pallet to a position of an empty parking space of racks formed in floors and a traction unit for moving the vehicle from the elevator into the empty parking space in a horizontal direction to store it. Of course, the delivery of a vehicle out of the parking space is performed in the reverse order to the entering of the vehicle.

However, the parking system must have a complex configuration because of requiring additional pallets and transact units except the elevator. During the operating of the system, a loading of the system is increased by a weight of the pallets, so it is undesirable in respect that a lot of power and much time are required for the transportation of the vehicle.

In particular, after the loading of the vehicle into a designated parking space of a rack, if some vehicle-free or empty pallets are placed on the parking places, the elevator is moved to the empty parking space to pull out the empty pallet therefrom and then ready for another parking operation at a carrying-in position to be on standby. During being on standby, the elevator carries the empty pallet loaded thereon to be put on another pallet-free parking space according to a delivery control signal and then again moved from the standby position to a target parking space to store another vehicle. As a result, the parking system using such movable pallets undesirably needs a relative longer time for loading vehicles into or unloading them out of the parking spaces of racks.

In order to overcome these and those problems, there has been proposed a palletless rack-type parking system for loading or unloading vehicles into or out of parking spaces of multistory racks without requiring additional pallets. Examples of palletless rack-type parking system are referred to International Laid-open Publication No. WO87/02405 entitled "A Vertical Storage Apparatus and Control Method Thereof" and Japanese Patent Laid-open Publication No. Heisei 5-52058 entitled "A Stacker Crane-type Parking Garage.

The vertical storage apparatus disclosed in WO 87/02405 comprises a single rack unit including an elevation space and multi-storied storage racks provided on at least one side out of the left side, right side, front side and rear side of the lift space. The rack comprises a plurality of storage forks normally arranged on every story thereof to form two rows spaced apart in a regular interval from each another. The elevation space defined between the storage spaces comprises a pair of elevation forks mounted to be moved up and down therein to carry vehicles in a vertical direction. The storage fork reciprocates between a storage space and the elevation space by a drive unit (not shown) in a manner to be moved toward or away from a position above or under the fork bars of the elevation forks according to the guidance of a horizontal guide beam of the rack. The elevation fork comprises a pair of elevation forks faced to each other, fork bars of which are vertically passed through between fork bars of the storage fork to be placed at a loading/unloading position in the elevation space, without interfering with the fork bars of the storage fork.

In a storage operation, the elevation fork loaded with a vehicle on its fork bars is first moved upward in the elevation space to a desired position higher than that of a target empty storage fork. The target empty storage fork is horizontally moved inward into the elevation space by means of the drive unit to a loading position under the fork bars of the elevation fork. The elevation fork is moved downward to cross the fork bars of the storage fork in order to load the vehicle onto the storage fork. The storage fork is returned by means of the drive unit to its original position, so that vehicle is entered into a storage space of the rack.

However, the vertical storage apparatus free of a pallet has problems in that the drive unit must be provided to operate each storage fork, independently, and the moving distance of the elevation fork is relatively longer, because the elevation fork passes through or cross the storage fork, vertically, during a loading or unloading operation.

Furthermore, the target storage fork must be horizontally moved to a loading or unloading position under or above an elevation fork 2 without causing any interference between the vehicle and any one of the storage and elevation forks. For it, a substantial travel of the elevation fork is a sum of adding an operational allowance to two heights of the storage fork and the elevation fork, which takes a relative longer time for the storage and delivery of the vehicle, so the vertical storage apparatus has a limitation to the reduction of time taken during a loading or unloading operation.

The loading structure for stacker crane-type parking garages described in Japanese Patent Laid-open Publication No. Heisei. 5-52058 comprises two racks installed on a support surface to be spaced apart at an interval from each other and a stacker crane (not shown) mounted between the racks to enable a lift fork to be moved up and down with being loaded with a vehicle. Multiple cantilever support bars are provided on the right and left shelf members of each rack to form a storage space inside horizontal support beams. The lift fork includes a plurality of arm bars provided on both sides of a body of the stacker crane to cross the support bars without any interference during being lifted or lowered in a protruded state.

In a loading operation, the lift fork loaded with the vehicle is first moved upward in an elevation space to a desired position higher than that of the support bar and then horizontally to be entered into a target empty storage space of the racks. Thereafter, the lift fork is moved downward to cross the support bar of the rack. During the downward movement of the lift fork, the arm bars pass through the spaces between the support bars without any interference to load the vehicle onto the support bars. The lift fork is, thereafter, laterally moved from the position under the support bars to a position inside the elevation space, prior to being moved to a standby position where another vehicle is loaded on the lift fork.

However, the loading structure is constructed such that the lift fork passes through the support bars 6 from above its upper portion to below its lower portion thereby to return to its original position, so it has a limitation to the time reduction in loading the vehicle into or unloading it out of the storage space due to a relatively longer traveling distance. Therefore, a substantial travel of the lift fork is a sum of adding an allowance for entering into/retreating from the rack to two heights of the support fork and the lift fork. It has a limitation to the shortening of a vertical traveling distance of the lift fork.

SUMMARY OF THE INVENTION

According to the present invention, in order to resolve these and those problems, an object of the present invention is to provide a palletless rack-type parking system for quickly, precisely and safely taking a vehicle into and/or taking it out of the parking space system using a stacker crane operable in more than two axial directions to a rack unit having a plurality of parking spaces without a separate vehicle loading pallet.

In order to accomplish the object of the present invention, a palletless rack-type parking system comprises:

a plurality of multistory racks each having a plurality of parking spaces in a lattice form and arranged on a support surface to be spaced apart from each another at a regular interval to form vertical spaces between them;

a plurality of storage fork bars each including a first projection tab projected from a predetermined portion of a lower surface thereof to have a predetermined height and horizontally mounted on an upper surface of a first support beam in a regular interval through the first projection tap to cross the support beam in a right angle, at least one end of which is projected longer from the support beam of the rack in a beam form;

a transporting fork including a plurality of transporting fork bars each with a second projection tap projected from a predetermined portion of a lower surface thereof to have a predetermined height, in which the transporting fork bar is not higher than that of the storage fork bar, and arranged in a regular interval in parallel to each another to be alternately positioned between the storage fork bars, and a second support beam arranged to cross the storage fork bar in a right angle and for supporting the second projecting tap facing its lower surface; and a stacker crane installed in each vertical space between two neighboring racks and operable in more than two-axial directions of leftward, rightward, upward and downward with the transporting fork being mounted thereon, in which the transporting fork laterally approaches the storage fork bars and the transporting fork bars enter into, moves up and down and retreats from the storage fork with being alternately overlapped between the storage fork bars.

According to the present invention, it is preferable that the upper surface of the transporting fork bar is positioned higher or lower than the upper surface of the storage fork bar by a predetermined level without any interference between them, when the transporting fork laterally approaches or withdraws from the storage fork bar.

It is more preferable that the heights of the storage fork bar and the transporting fork bar are equal to each other and the heights of their first and second projection tap are equal to each other, the height of the projection taps is determined to be at least larger than a level difference to be kept between the upper surfaces of the transporting fork bar and the storage fork bar, when the transporting fork laterally approaches or withdraws from the storage fork bar.

Accordingly, when the transporting fork approaches or withdraws out of the storage fork bar, the present invention enables any one of fork bars to be lifted up to at least minimum allowance gap relative to the other. It is possible for a vehicle to be quickly and safely taken into or taken out of a parking space without causing any interference between the fork and its relative fork bar and also excludes the use of a separate pallet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
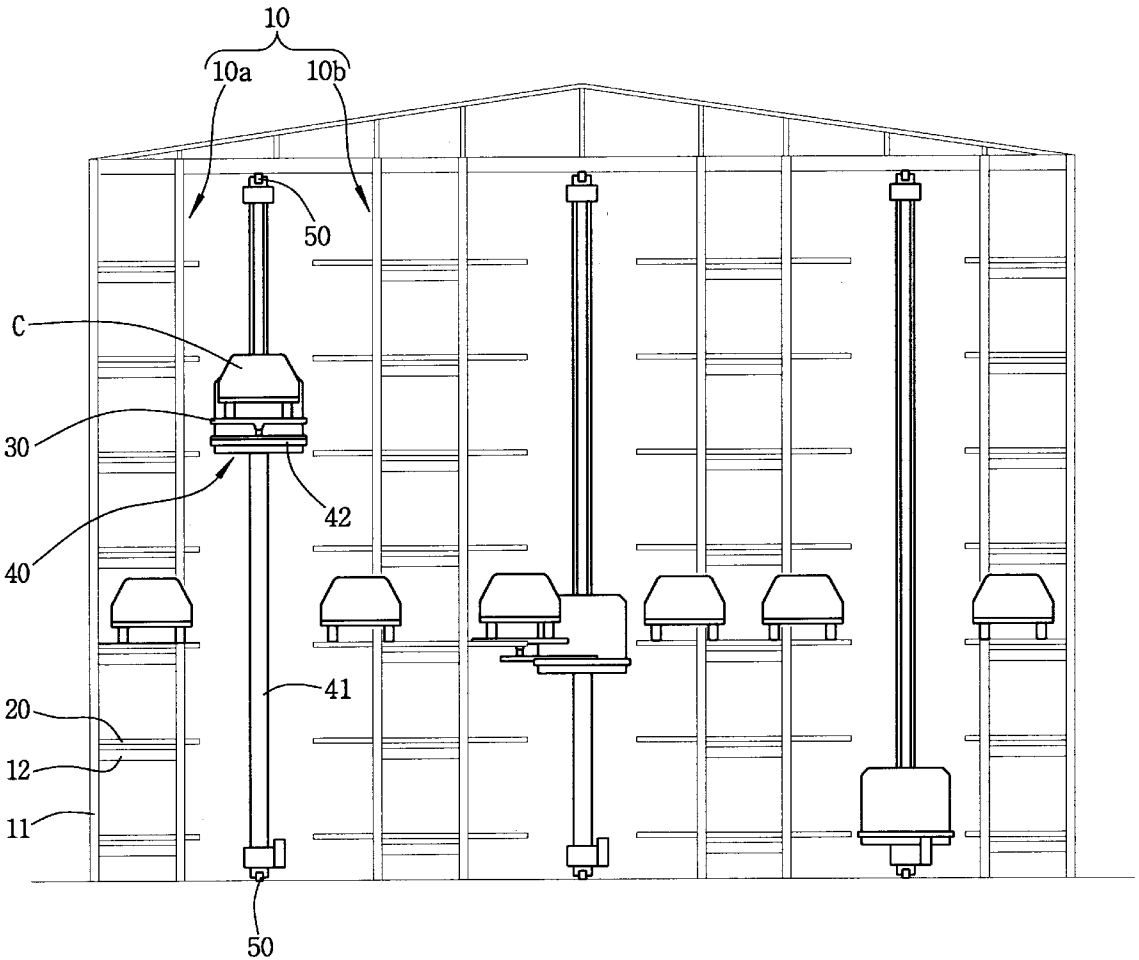
FIG. 1 is schematically a front view illustrating a palletless rack-type parking system using a stacker crane according to the present invention.
Figure 2:
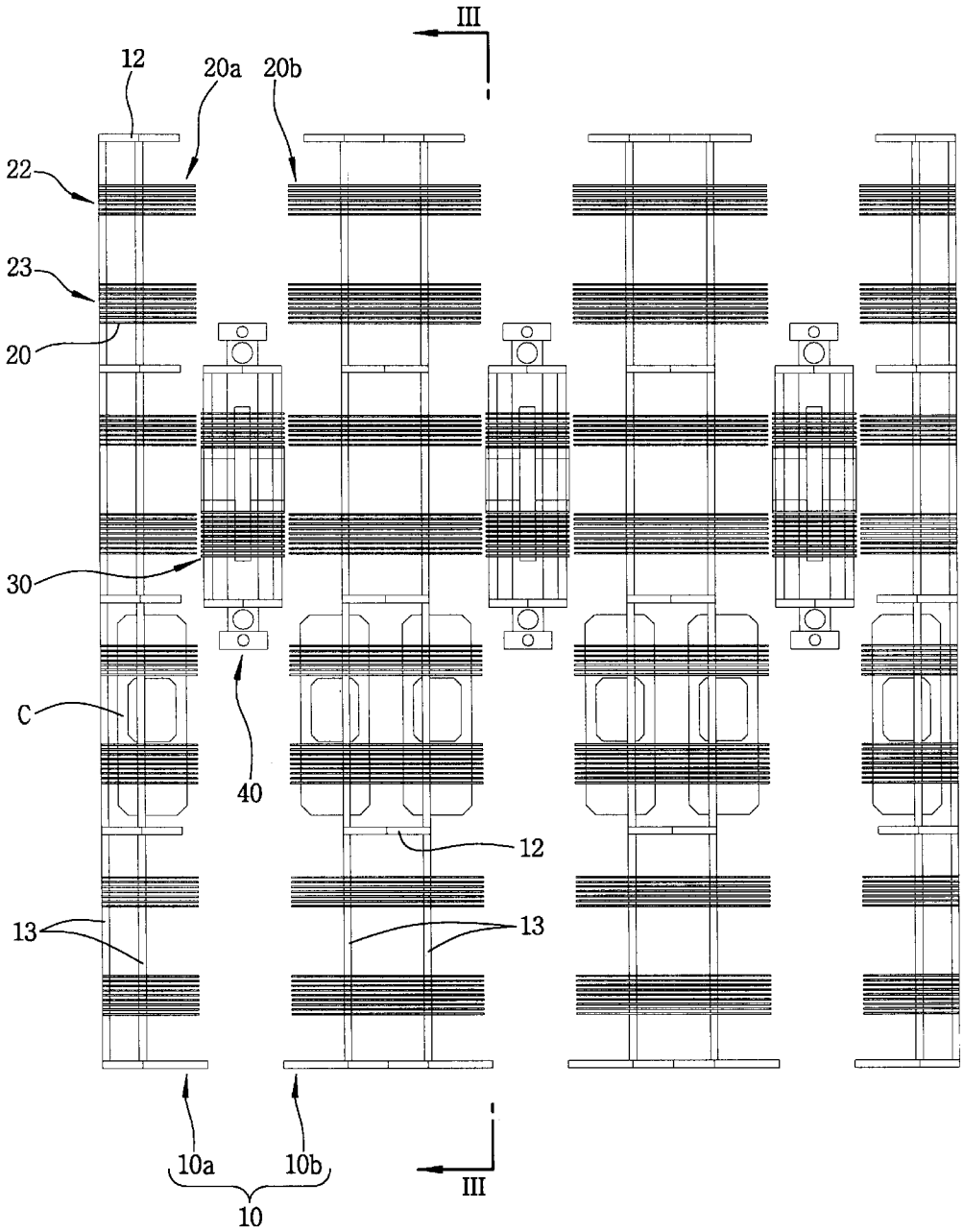
FIG. 2 is a plan view illustrating the palletless rack-type parking system of FIG. 1.
Figure 3:
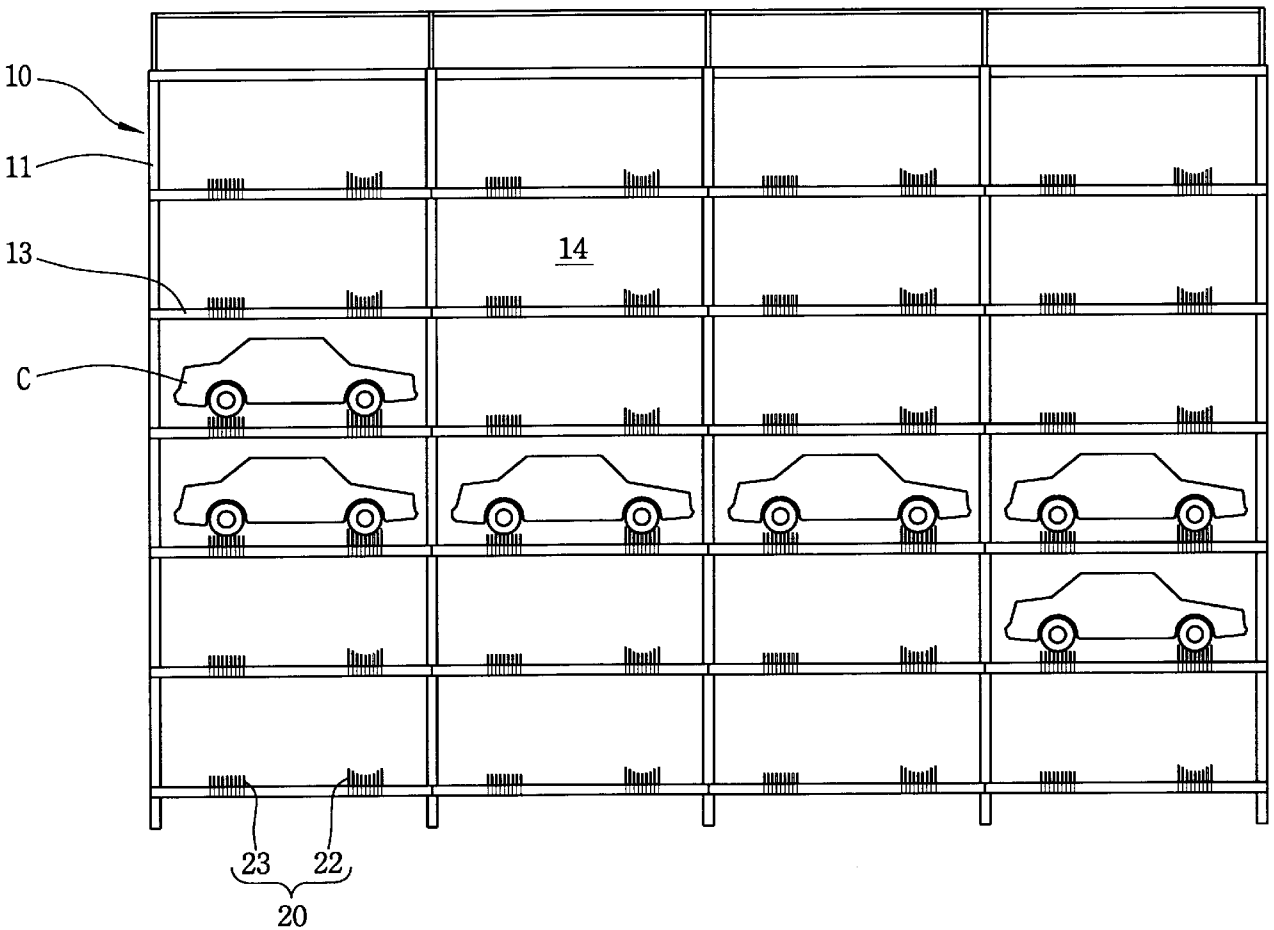
FIG. 3 is a side view illustrating the palletless rack-type parking system taken along the line III—III of FIG. 2.
Figure 4:
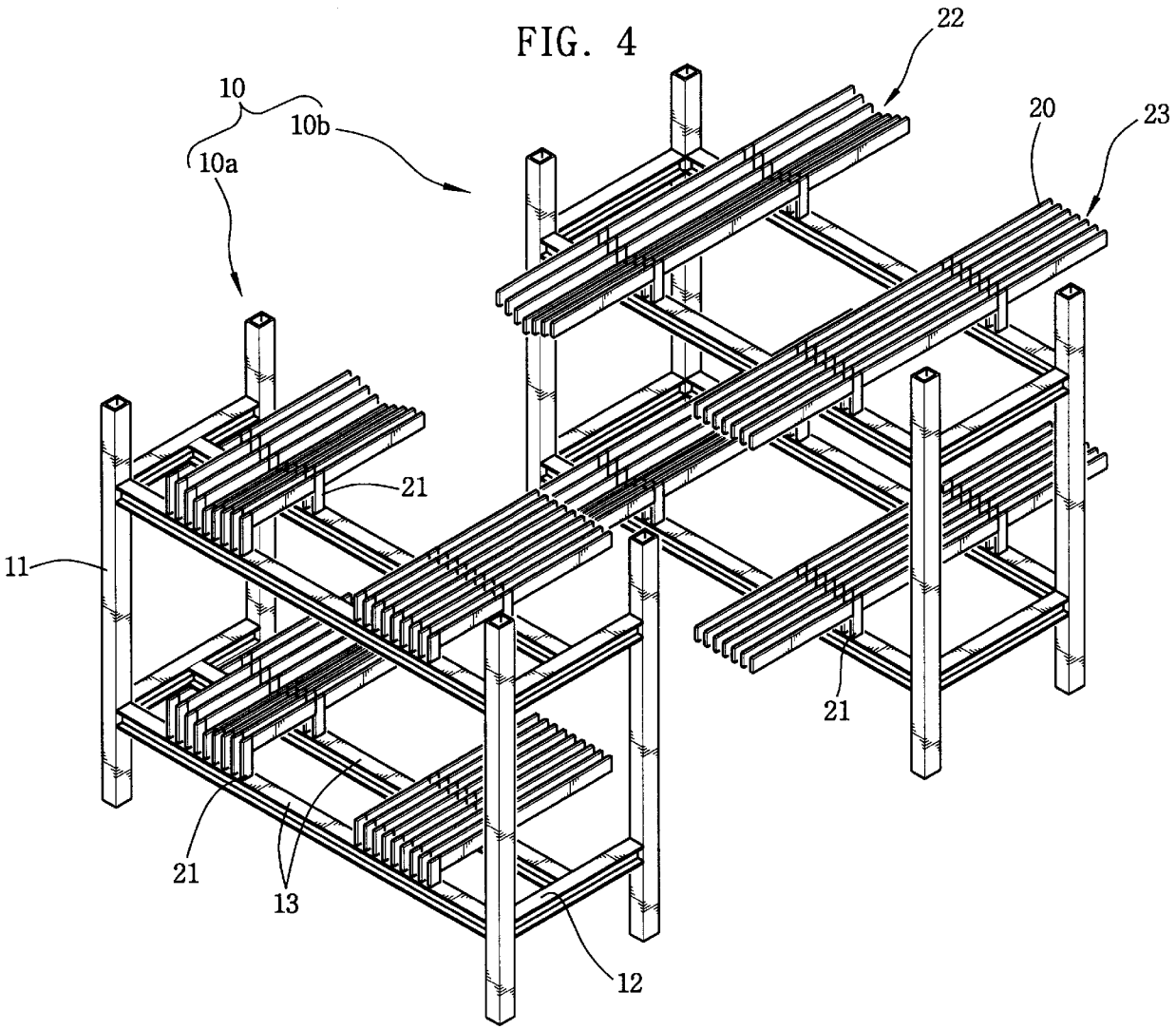
FIG. 4 is an enlarged perspective view illustrating racks of the palletless rack-type parking system in part according to the present invention.

Reference should now be made to the drawings, in which the same reference numerals are used throughout the different drawings to designate the same or similar components.

Referring to FIGS. 1 to 5, according to a primary embodiment of the present invention, a palletless rack-type parking system using a stacker crane comprises a plurality of racks 10 arranged in a lattice form to be spaced away in a regular interval from each another in order to have a plurality of parking spaces 14, a plurality of storage fork bars 20 mounted in each of the parking spaces 14 of the rack 10 to support a vehicle C thereon and a transporting fork 30 arranged to take the vehicle C into or take it out of the storage fork bar 20 as it laterally approach or withdraw from the storage fork bar 20 and a stacker crane 40 moving the transporting fork 30 in at least two axial directions, for example three axial directions of forward and backward, leftward and rightward, upward and downward.

Each rack 10 fundamentally comprises a plurality of vertical posts 11 arranged in two rows to be spaced away in a regular interval from each another and a plurality of horizontal support beams 12 and 13 arranged to lie in a right angle between the neighboring ports 11. The horizontal support beams 12 and 13 are mounted on every regular height along the lengthwise portion of the posts 11 to form a plurality of parking spaces 14 in a regular vertical interval in the rack 10.

The storage fork bar 20 is in a long plate form with predetermined thickness and width, which is mounted straightly and widthwise on the upper surface of a longitudinal first horizontal support beam 13 to be in a right angle therewith. A plurality of storage fork bars 20 are arranged along the lengthwise of the horizontal support beam 13 to be spaced away in an interval larger than its thickness from each another.

At least one end of the storage fork bar 20 is in the form of a cantilever beam horizontally projected longer from the horizontal support beam 13 to allow the transporting fork 30 to laterally approach or withdraw from the storage fork bars 20, with the fork bars 32 of the transporting fork 30 being alternatively overlapped between the storage fork bars 20. Therefore, the storage fork bar 20 is formed on the whole as a fork-shaped configuration.

Each storage fork bar 20 includes two second projection taps 21 having a predetermined height, which is integrally provided on the lower surface thereof to be spaced away in an interval from each other. The storage fork bar 20 is horizontally mounted through the first projection taps 21 on an upper surface of a first horizontal support beam 13 of the rack 10.

Herein, it is noted the storage fork bars 20 may be entirely mounted on the support beam 13 throughout the parking space 14 of the rack 10, but it is preferable that the storage fork bars 20 include a front fork bar group 22 and a rear fork bar 23 spaced away from each other to be arranged to support only parts on which a vehicle C is laid, for example front wheels $W_f$ and rear wheels $W_r$.

Figure 5:
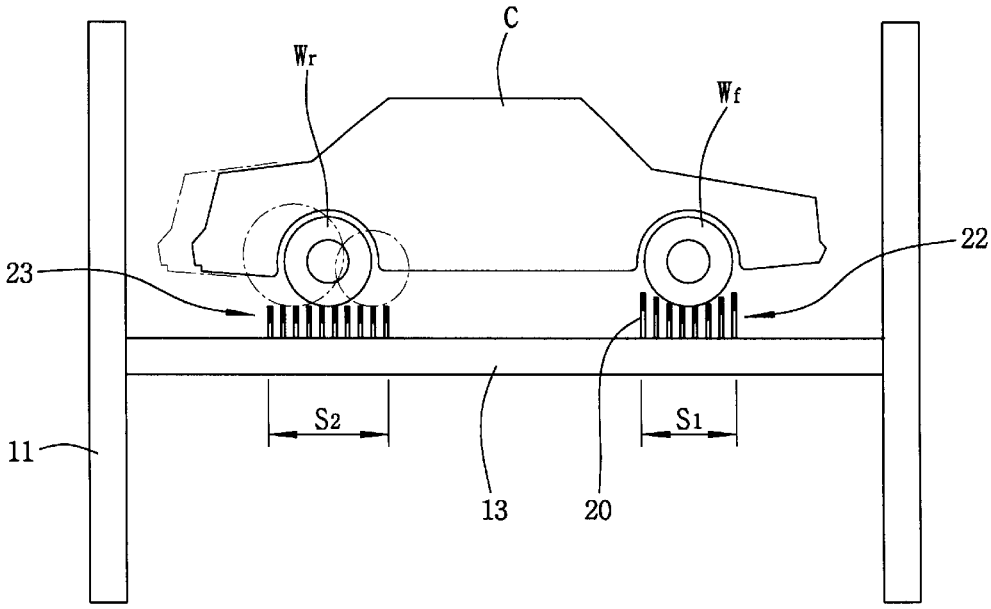
FIG. 5 is a side view illustrating the rack of FIG. 4 on which a vehicle is parked.

On the other hand, a distance between the front and rear wheels of the vehicle C becomes different according to a vehicle model. Considering it, it is necessary to construct the rear fork bar group 23 to have a relative wider width "$S_2$" than a width "$S_1$" of the front fork bar group 22, as shown in FIG. 5.

An interval between the front and rear fork bar groups 22 and 23 is determined to be larger than a shortest wheelbase in vehicles on the market. The width "$S_2$" of the rear fork bar group 23 is determined to be larger than a distance difference between a longest wheelbase and a shortest wheelbase in vehicles on the market. Of course, the vehicles considered in design of the parking system of the present invention are limited to vehicles that may be parked in the system without causing any problem.

The width "$S_1$" of the front fork bar group 22 is preferably determined to be larger than a largest outer diameter in tires. The storage fork bars 20 constituted as the front fork bar group 22 has a different height from each another to correspond to a circular tread of the front wheels $W_f$.

Therefore, the front fork bar group 22 forms a curved depression coinciding with an arc tread of the front wheels. The curved depression of the front fork bar group 22 functions to prevent an undesired movement of the vehicle C parked on the storage fork bars 20 as a reference base.

It is noted that the rack 10 and the storage fork bar 20 can have somewhat different configuration according to an installing position of the rack.

That is, in case of an edge rack 10*a* positioned at the outmost side of a plurality of racks 10, the storage fork bars 20*a* are projected only from one side of the rack 10*a*, because the transporting fork 30 approaches and withdraws only in one direction from the left and right sides of the storage fork bar 20*a*, thereby allowing the storage of vehicles C in one row of the edge rack 10*a*.

In order to allow the fork bars of the transporting fork 30 to laterally and smoothly approach or withdraw from the storage fork bars 20*a* with being horizontally alternated with each other, it is necessary to substantially project the ends of the storage fork bars 20*a* from the support beam 13 arranged on the transporting fork approaching side of the edge rack 10*a*. However, if the storage fork bars 20*a* are arranged on the middle portion of the support beam 13 in a normal manner, the end rack 10*a* must have an idle space necessary for projecting the end of the storage bars 20*a* out of it, so it increase an installing area of a system. For it, a width of the rack 10*a* may be reduced to avoid the idle space. At that case, it is very unfavorable for the structural safety of the rack 10*a*.

Therefore, it is preferable to allow the projection of the storage bar 20*a* out of the edge rack 10*a* by a predetermined length to enter the transporting fork 30 into or withdraw it from the storage bar 20*a*, whereby the long horizontal support beam 13 is mounted at its both ends to each of two short horizontal support beam 12 to be leaned inward toward an outmost post 11 of the edge rack 10*a* opposite to the transporting fork approaching side. For it, the storage fork bar 20*a* includes first projection taps 21 formed at its one end opposite to the transporting fork approaching side and a position near to its middle portion. The storage fork bars 20*a* form a desired cantilever beam that allows the transporting fork 30 to laterally and smoothly approach them from the transporting fork approaching side.

The support beam 13, arranged to the transporting fork approaching side of each edge rack 10*a*, is thus eccentrically positioned inward from the middle portion of each storage fork bar 20*a* opposite to the transporting fork approaching side in order to allows the transporting fork 30 to completely approach the storage fork bars 20*a* in a horizontal direction. In that case, an eccentric amount of the support beam 13 of he end rack 10*a* is determined to be at least larger than a width of a support beam 31 of the transporting fork 30. The support beam 31 of the transporting fork 30 may be occasionally referred to as a second support beam later herein so as to distinguish it from the first support beam 13. Therefore, it allows vehicles C to almost completely fill the parking spaces 14 of the racks 10*a* without leaving a large idle space in the racks 10*a* and achieves a desired structural stability of the racks 10*a*.

Intermediate racks 10*b* are installed between the outmost racks 10*a*, from both side of which vehicles C are taken into or taken out of the storage fork bars 20*b* in two rows. The storage fork bar 20*b* of the intermediate rack 10*b* have a length twice as long as that of the storage fork bars 20*a* of the end racks 10*a*. The storage fork bars 20*b* cross two longitudinal horizontal support beams 13 in a right angle to allows their both ends to be projected outside from each of the two support beams 13 opposite to each other, thereby creating an equal-arm beam structure. The storage fork bar 20*b* of the intermediate rack 10*b* includes two lower projecting taps 21 formed on two positions to be spaced apart in a constant interval from the middle portion of the storage fork bar 20*b* opposite to each other.

In order to allow a complete lateral approach of a transporting fork 30 relative to the storage fork bars 20*b* of the intermediate rack 10*b*, the support beam 13 is positioned inward from both ends of each transporting fork bars 20*b* by more than at least ½ of a sum of a length of the transporting fork bar 32 and widths of the first and second support beams 13 and 31.

Figure 6:
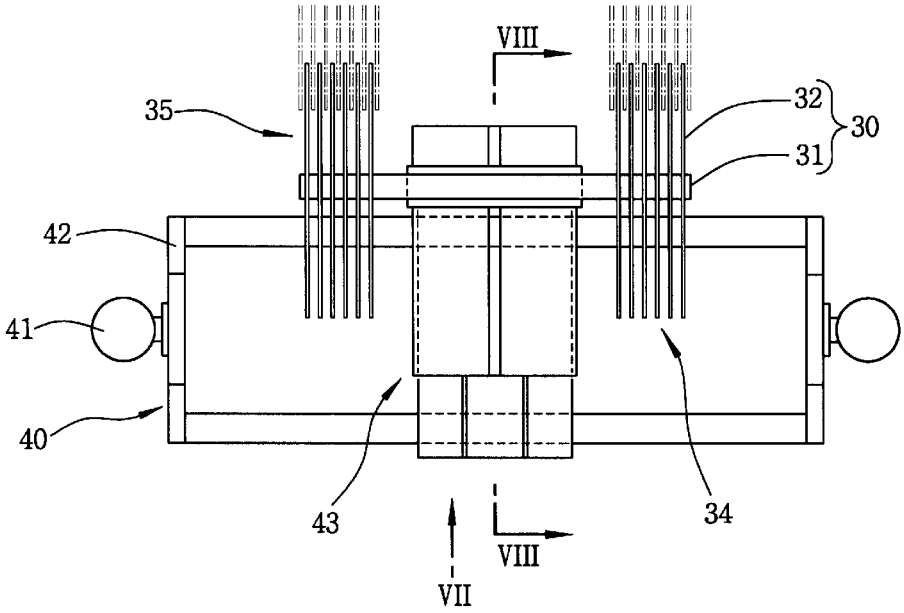
FIG. 6 is a plan view illustrating a transporting fork of the palletless rack-type parking system according to the present invention.
Figure 7:
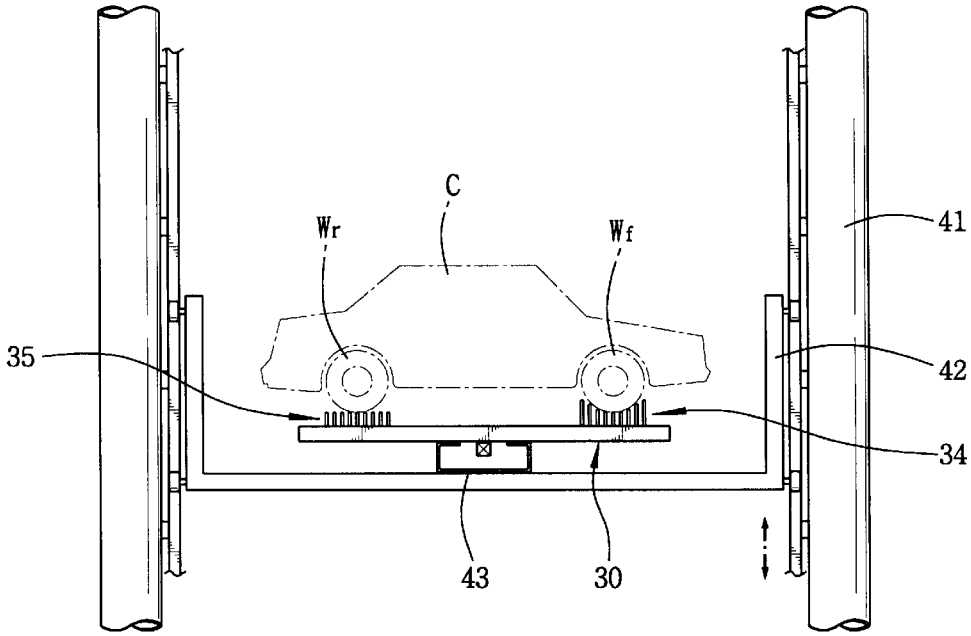
FIG. 7 is a side view illustrating the transporting fork viewed in a direction as shown by the arrow VII of FIG. 6, with a vehicle loaded on the transporting fork as shown by the phantom line.

As shown in FIGS. 6 and 7, the transporting fork 30 comprises a plurality of transporting fork bars 32 arranged in a regular line with the storage fork bar 20 and a support beam 31 integrally mounted on the lower middle surface of the transporting fork bars 32 to cross the transporting fork bar 32 in a right angle, thereby supporting the transporting fork bars 32.

The transporting fork bar 32 is made in the form of a long strip with a predetermined thickness and width in the same manner as that of the storage fork bar 20. The transporting fork bars 32 are mounted on the upper surface of the second support beam 31 with being raised widthwise, which are spaced apart in an interval larger than a thickness of the storage fork bar 20 to be laterally and smoothly superposed between the storage fork bars 20.

Figure 8:
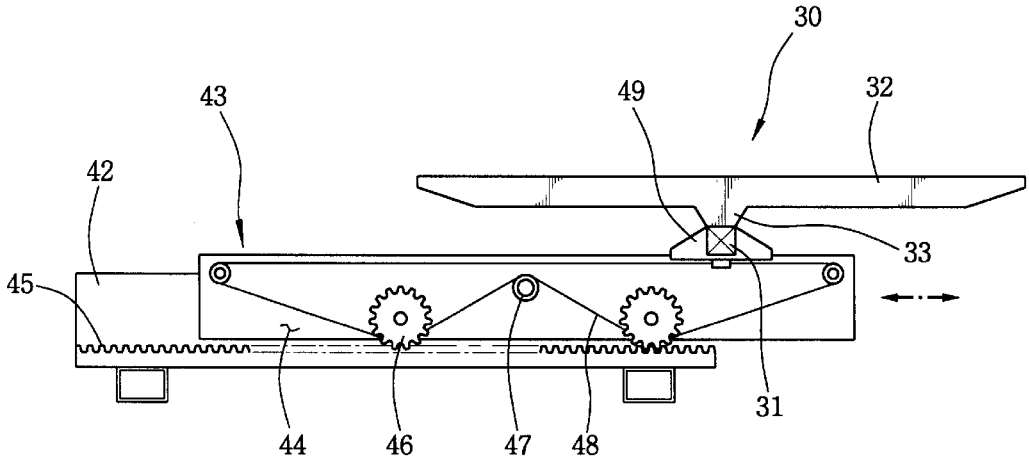
FIG. 8 is a cross-sectional view illustrating the transporting fork taken along the line VIII—VIII of FIG. 6.
Figure 9:
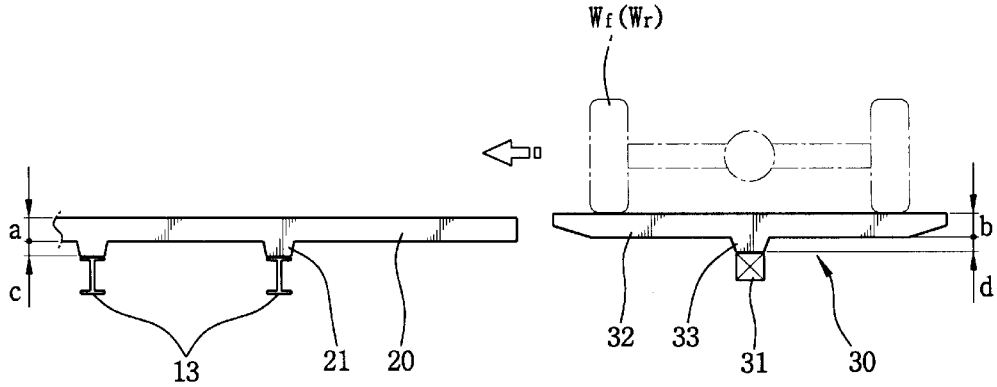
FIG. 9 is a side view illustrating the storage fork bar and the transporting fork of the palletless rack-type parking system according to the present invention.

As shown in FIGS. 8 and 9, the transporting fork bar 32 includes a projection tap 33 having a predetermined height integrally formed on the lower middle surface thereof. The transporting fork bar 32 is mounted to the support beam 31 through the lower projection taps 33. The lower projection tap 33 of the transporting fork bars 32 may be occasionally referred to as a second lower projecting tap so as to distinguish them from the first lower projection taps 21. And, the transporting fork bars 32 may be entirely installed on the second support beam 31, but it is preferable that the transporting fork bars 32 are sectioned into a front fork bar group 34 and a rear fork bar group 35 so as to separately support the front wheels $W_f$ and rear wheels $W_r$ of a vehicle C in the same manner as that of the storage fork bars 20.

The interval between the front and rear fork bar groups 34 and 35, each width of the front and rear fork bar groups 34 and 35 and a shape of the front fork bar group 34 are designed in the same manner as those of the storage fork bars 20, the detailed explanation of which is omitted for the purpose of avoiding the overlapping.

A height "a" of the storage fork bars 20 is equal to a height "b" of the transporting fork bars 32, and a height "c" of the first lower projecting taps 21 is equal to a height "d" of the second lower projecting tap 33. Each of the heights "c" and "d" of the first and second lower projecting taps 21 and 33 is determined to be at least larger than an operational allowance "$g_1$" or "$g_2$" defined between the upper surfaces of the transporting fork bar 32 and the storage fork bar 20 to avoid any interference with the vehicle C, when the transporting fork bar 32 laterally approach or withdraw from the storage fork bar 20 to load or unload the vehicle.

For example, when the transporting fork 30 loaded with a vehicle C laterally approaches the storage fork bar 20, it is necessary to position the upper surface of the transporting fork bar 32 at a level higher than the upper surfaces of the storage fork bars 20 by an allowance "$g_1$" to avoid any inference between the vehicle C and the upper surface of the storage fork bar 32.

On the contrary, when the transporting fork 30 withdraws from the storage fork bar 20 after loading the vehicle C onto the storage fork bar 20, it is required to position the upper surface of the transporting fork bar 32 at a level lower than the upper surface of the storage fork bar 20 by a lower allowance "$g_2$" in order to avoid any interference between the vehicle C and the upper surface of the transporting fork bar 32. Of course, the delivery of the vehicle C out of the storage fork bar 20 of a target parking space is performed contrary to the procedures of the vehicle storage.

Therefore, during the advancing and retreating of the transporting fork 30, the storage fork bar 20 has to be free from the interference with the support beam 31 of the transporting fork 30, and the transporting fork bar 32 has to be free from the interference with the support beam 13 of the storage fork bar 20. Each of the heights "c" and "d" of the first and second projection taps 21 and 33 is thus determined to be at least larger than each of the operational allowances "$g_1$" and "$g_2$".

The upper and lower operational allowances "$g_1$" and "$g_2$" are set at the minimum gaps which allows the storage and transporting fork bars 20 or 32 to be free from the interference with the vehicle C which is transported by the transporting fork 30 or loaded on the storage fork bars 20.

A stacker crane 40 is mounted in a vertical space between racks 10 to move forward and backward along rails 50 mounted on a ceiling and bottom of a system, longitudinally. A carriage 42 is moved upward and downward along masts 41. The transporting fork 30, in place of a conventional laterally movable attachment fork, is installed in the carriage 42 to move the transporting fork 30 leftward and rightward by a drive unit 43 therein.

The drive unit 43 may be in the form of various types, but it has a two-stage sliding structure that is at the same time to quickly load the vehicle C onto or unload it from the storage fork bars 20.

For example, as shown in FIG. 8, a slider 44 is installed on the carriage 42 to engage a rack gear 45 with two pinion gears 46. A chain 48 driven by a motor 47 is installed on the slider 44 to rotate the pinion gears 46. A bracket 49 is provided at an appropriate position of the chain 48 to mount the transporting fork 30 thereon.

In order to load the vehicle C on the transporting fork 30 or delivery the vehicle C taken out of the storage fork bar 20 of the rack 10, there must be provided an entering/delivering apparatus at an exit/entrance of a system, which may be constructed as various types.

Figure 10:
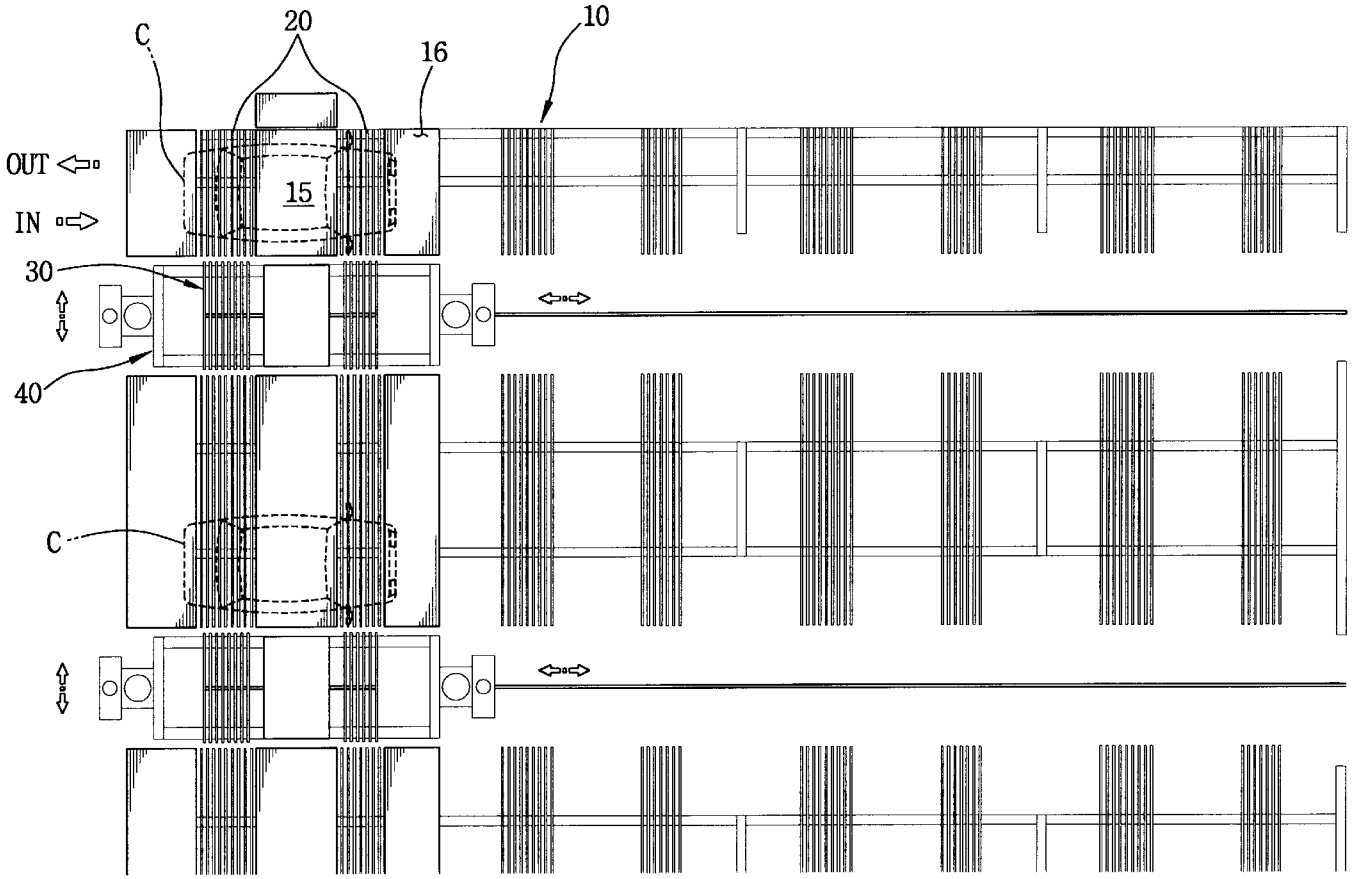
FIG. 10 is a schematic plan view illustrating a standby state of the palletless rack-type parking system for entering and delivering a vehicle according to the present invention.

As shown in FIG. 10, an example of the entering/delivering apparatus is shown. A parking space 14 formed at the foremost position of one edge rack 10 is designated as a standby space 15 for entering/delivering vehicles C to be communicated with an exit/entrance of a housing (not shown) covering the racks 10. In that case, a floor 16 is preferably laid on an area free of the storage fork bar 20 in the standby space 15, which is flush with the storage fork bars 20. The floor 16 forms a driver's passage that allows a driver to easily and safely pass through the standby space 15. If necessary, an exit or entrance door may be provided in the housing for drivers. In case of intermediate racks 10*b* having two rows of parking spaces 14 per every story, one foremost parking space 14 may be designated as a standby space 15, and other foremost parking space 14 may be used as a driver's passage.

The operation of a palletless rack-type parking system with stacker cranes according to the present invention will be described herein below with reference to FIGS. 11*a* to 11*d*, FIGS. 12*a* to 12*d*, and FIG. 13.

When parking a vehicle C in a designated parking space 14 of a rack 10, the vehicle C is moved into a standby space 15 of the rack 10 until the front and rear wheels $W_f$ and $W_r$ of the vehicle C are completely seated on the storage fork bars 20 of the front and rear fork bar groups 22 and 23, as shown in FIG. 10.

A parking system is, thereafter, operated under the control of a control unit (not shown) to laterally move the stacker crane 40 from the vertical space of the rack 10 into the standby space 15 with the transporting fork 30 mounted thereon. The vehicle C is thus loaded on the storage fork bars 20 of the standby space 15 through the transporting fork 30. Next, the later operating of the transporting fork bar 20 is the same as that of the vehicle delivery as will be described later herein.

Figure 11A:
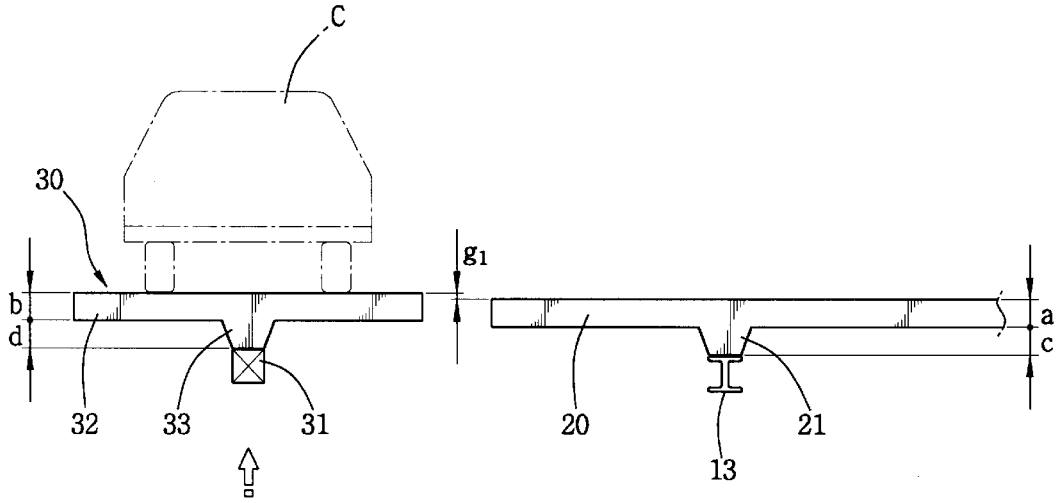
FIGS. 11*a*, 11*b*, 11*c* and 11*d* are side views illustrating the parking procedures of the palletless rack-type parking system in orders according to the present invention.

When the transporting fork 30 that the vehicle C is loaded on withdraws from the standby space 15, the stacker crane 40 is moved along the rails 50 and, at the same time, the carriage 42 is moved upward or downward along the mast 41 to an empty parking space 14 of the rack 10 in the shortest distance from the standby space 15. At that time, as the stacker crane 40 is operated under the control of a sensor (not shown, the transporting fork 30 is stopped at the position around the designated parking space 14 that the upper surface of the transporting fork bar 32 are raised upto a level higher than the upper surface of the storage fork bars 20 by the upper allowance "$g_1$", as shown in FIG. 11*a*.

Figure 11B:
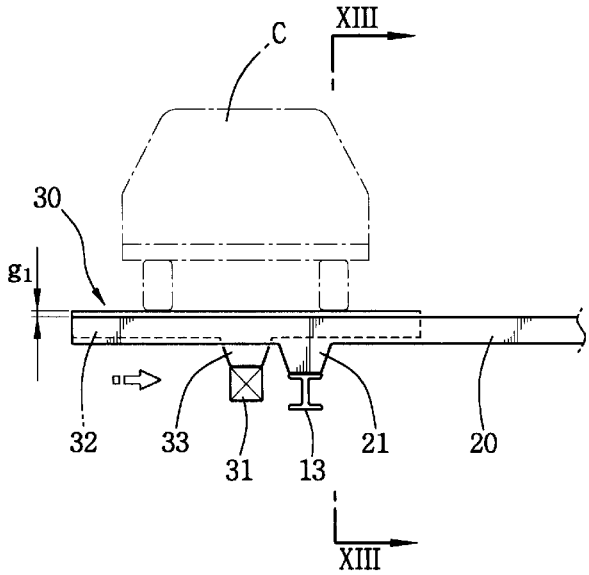

As shown in FIG. 11*b*, according to the operation of the drive unit 43 installed on the carriage 42, the transporting fork 30 laterally approaches the storage fork bar 20 to force the transporting fork bars 32 to be alternately positioned between the storage fork bars 20. At that time, the support beam 31 desirably approaches a position just around the support beam 13 placed at the transporting fork approaching side of the storage fork bar 20 without interfering with the upper surface of the storage fork bar 20, because the transporting fork bar 32 includes a projecting tap 33 formed on the lower middle surface thereof and having a predetermined height "d" larger than the upper allowance "$g_1$".

At the same time, the transporting fork bars 32 are completely advanced into the storage fork bars 20 without because the support beam 13 on the transporting fork approaching side is positioned inside to be leaned toward the opposite direction to the transporting fork approaching-side by a distance at least larger than ½ of a sum of a length of the storage fork bar 20 and widths of the first and second support beams 13 and 31.

Figure 11C:
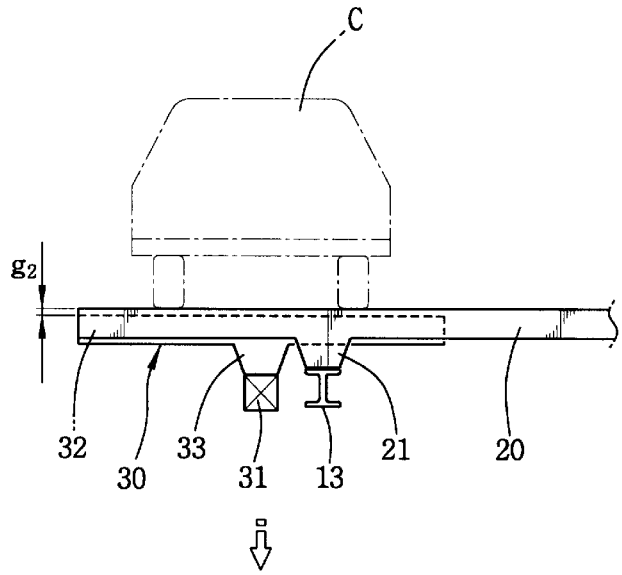

Thereafter, as shown in FIG. 11*c*, the carriage 42 of the stacker crane 40 is moved downward by a height equal to a sum of the upper and lower operational allowances "$g_1$" and "$g_2$". It gets the upper surface of the transporting fork bars 32 to be positioned at a level lower than the upper surfaces of the storage fork bars 20 by the lower allowance "$g_2$", thereby enabling the vehicle C to be loaded from the transporting fork bars 32 onto the storage fork bars 20.

This case also doesn't not causes any interference between the transporting fork bars 32 and the support beam 13 of the storage fork bars 20, because a height "c" of the lower projection tap 21 of the storage fork bars 20 is determined to be at least larger than the lower allowance "$g_2$".

Figure 11D:
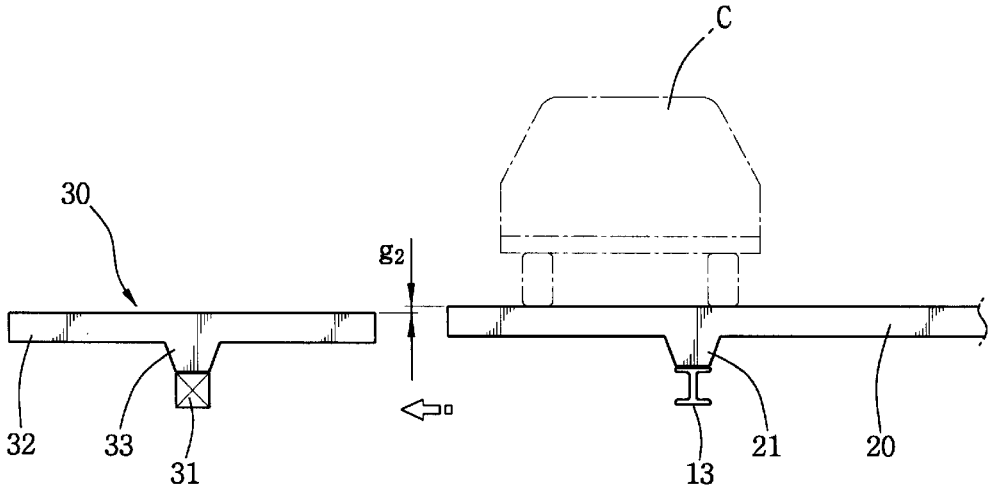

As shown in FIG. 11*d*, after loading the vehicle C onto the storage fork bars 20, as the drive unit 43 of the stacker crane 40 is returned to its original position in the elevation space, the transporting fork 30 laterally withdraws from the storage fork bars 20 thereby to accomplish the loading operation for storing the vehicle C on the storage fork bars 20.

Figure 12A:
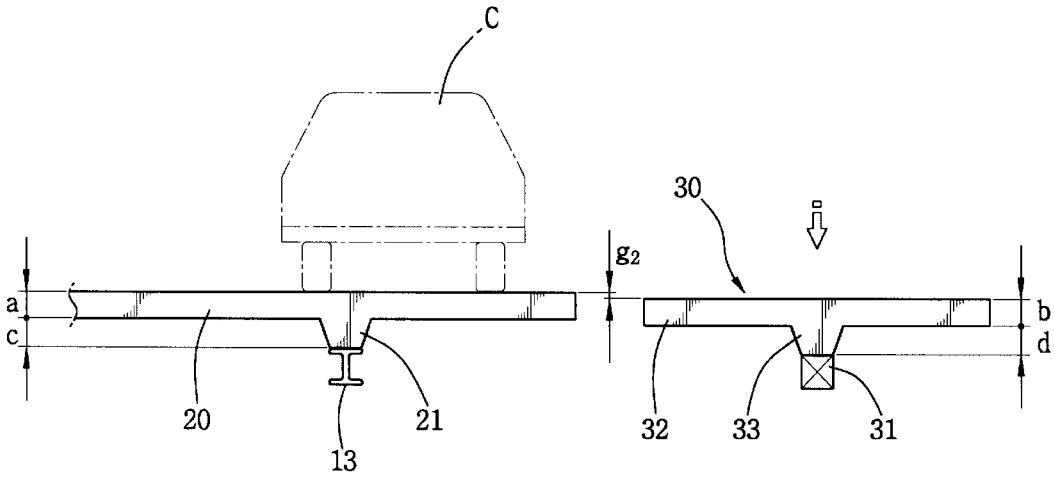
FIGS. 12*a*, 12*b*, 12*c* and 12*d* are side views illustrating the delivering procedures of the palletless rack-type parking system in orders according to the present invention.

On the contrary, In case of taking the vehicle C out of a designated parking space 14 of a rack 10, as shown in FIG. 12*a*, the empty transporting fork 30 is moved by the carriage 42 of the stacker crane 40 to a designated parking space 14 loaded with a vehicle C to be delivered. At that time, the upper surface of the transporting fork bar 32 is placed at a level lower than the upper surface of the storage fork bar 20 by the lower allowance "$g_2$" contrary to be placed at time of the loading operation.

Figure 12B:
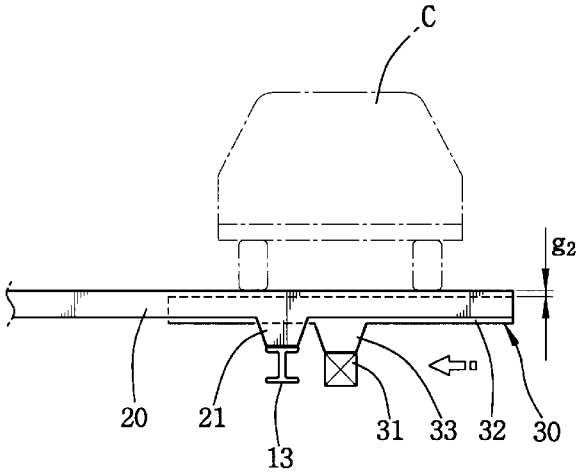
Figure 12C:
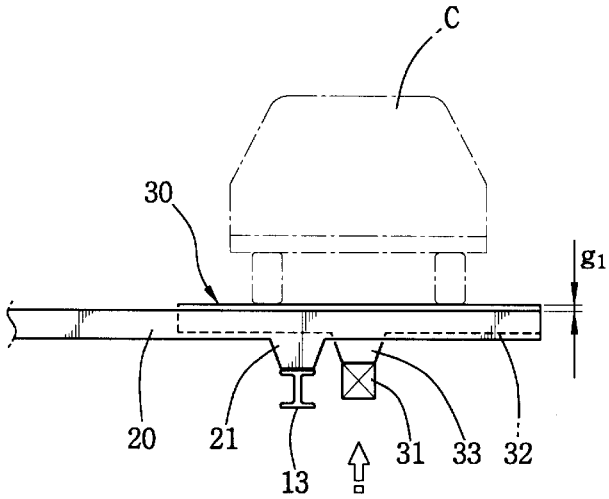

As shown in FIG. 12*b*, the transporting fork 30 laterally approaches the storage fork bars 20 to be alternately supposed with the storage fork bars 20. And then, as shown in FIG. 12*c*, the transporting fork 30 is moved upward by a height equal to the sum of the upper and lower allowances "$g_1$" and "$g_2$" thereby position the upper surfaces of the transporting fork bars 32 at a level higher than the upper surfaces of the storage fork bars 20 by the upper allowance "$g_1$". It enables the vehicle C to be loaded from the storage fork bars 20 onto the transporting fork bars 32.

Figure 12D:
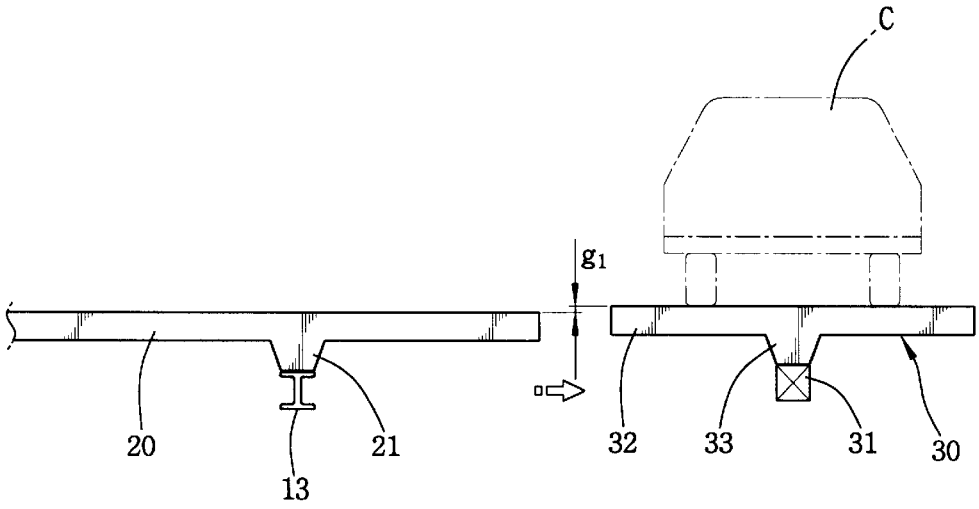
Figure 13:
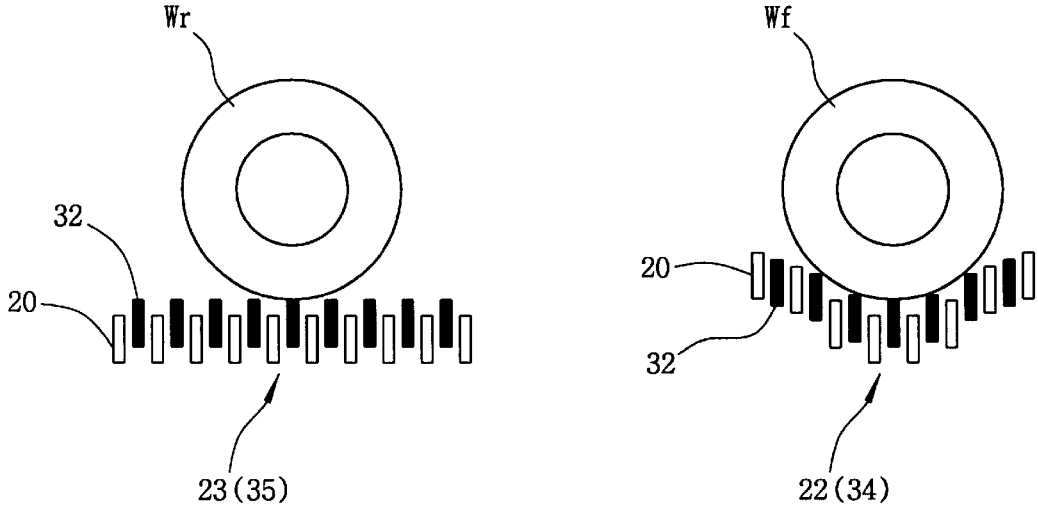
FIG. 13 is a cross-sectional view taken along the line XIII—XIII of FIG. 11*b*.

As shown in FIG. 12*d*, after completing the loading of the vehicle C onto the transporting fork 30 as described above, the transporting fork 30 is returned to its original position in the elevation space by the drive unit 43 and then moved to the standby space 15 of the rack 10 by the stacker crane 40. When the transporting fork 30 loaded with the vehicle C reaches a position around the standby space 15, the transporting fork 30 laterally approaches the storage fork bars 20 of the standby space 15 to load the vehicle C onto the storage fork bars 20 in the same manner as those of the loading operation.

As described above, according to the primary embodiment of the present invention, the palletless rack-type parking system enables the transporting fork 30 to laterally approach or withdraw from the storage fork bar 20 at an almost equal level with the storage fork bars 2 and to move the transporting fork 20 upward and downward by the sum of the upper and lower allowances "$g_1$" and "$g_2$" at a minimum, thereby loading or unloading the vehicle C. It simplifies the configuration of a parking system and minimizes the time taken in entering and delivering the vehicle C.

Figure 14:
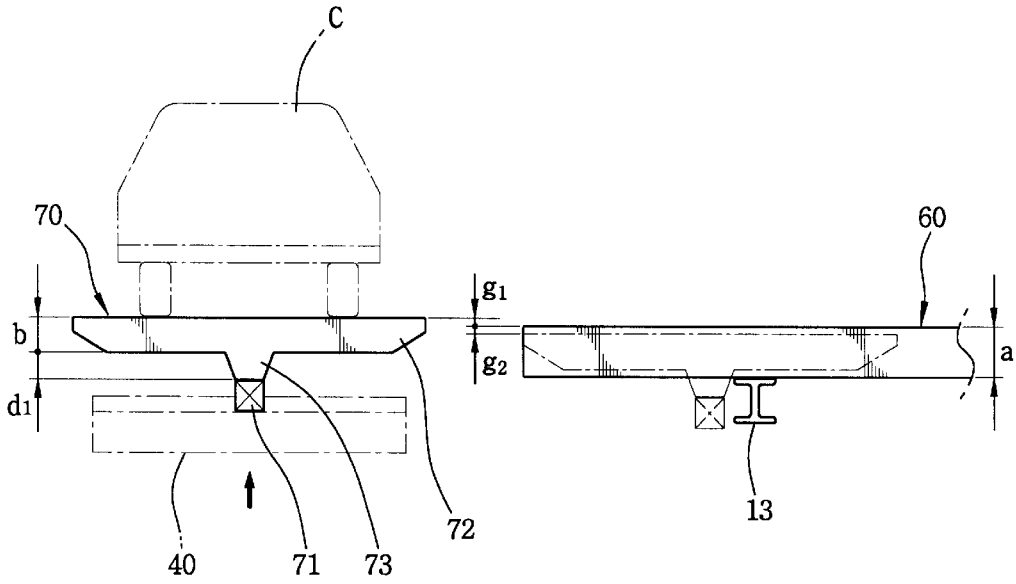
FIGS. 14 and 15 are schematically side views illustrating important elements of a palletless rack-type parking system using a stacker crane according to other embodiments of the present invention, respectively.

FIG. 14 shows a palletless rack-type parking system with stacker cranes according to a second embodiment of the present invention.

According to the second embodiment, a height "b" of a transporting fork bar 72 of a transporting fork 70 is subject to be less than a height "a" of a storage fork bar 60. A projection tap 73 is provided on the lower surface of each transporting fork bars 72 to have a predetermined height "$d_1$".

A height difference between the storage fork bar 60 and the transporting fork bar 72 is determined to be larger than upper or lower operational allowance "$g_1$" or "$g_2$". A height "$d_1$" of the projection tap 73 is determined to be larger than a sum of the upper and lower operational allowances $g_1$ and $g_2$ which are required by the transporting fork 70 to smoothly load or unload the vehicle C onto or from the storage fork bars 60, that is, $d_1>g_1+g_2$.

In that case, the entire height "$d_1$+b" of the transporting fork bar 72 plus the lower projecting tap "$d_1$" is larger than the height "a" of each storage fork bar 60 by at least the upper allowance "$g_1$". Therefore, even though the transporting fork 70 laterally approaches the storage fork bar 60 with the upper surfaces of the transporting fork bars 72 placed at a level higher than the upper surface of the storage fork bar 60 by the upper allowance "$g_1$", the support beam 71 of the transporting fork 70 effectively can avoid any interference with the end of the storage fork bars 60 due to the taps 73.

In addition, the height "a" of the storage fork bar 60 is larger than the height "b" of the transporting fork bar 72 by at least the lower allowance "$g_2$". Therefore, after completely approaching the storage fork bars 60, the transporting fork 70 is smoothly moved downward in a vertical direction relative to the storage fork bars 60 to position the upper surface of the transporting fork bar 72 at a level lower than the upper surface of the storage fork bar 60 by the lower allowance "$g_2$". The transporting fork 70 thus effectively loads the vehicle C onto the storage fork bars 60 without causing any interference between the lower surface of the transporting fork bar 72 and the support beam 13 of the storage fork bar 60.

Particularly, in the second embodiment, the front storage bars 22 may have different heights in their positions, but it is preferable that the storage fork bars 22 have the same height to each another and respectively includes a connecting tap (not shown) mounted in different heights from each another on its lower portion to be increased from the center toward both outsides, thereby forming its entire shape as a arc cross-section. In that case, the transporting fork bar 72 also is provided with the projection tap 73 of the height "$d_1$" that is increased from the center toward both outsides.

Figure 15:
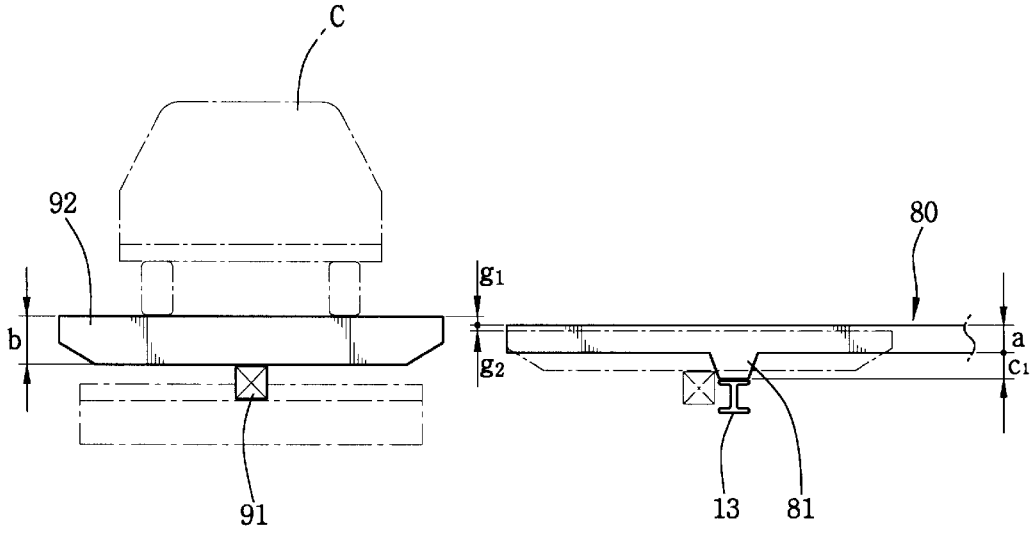

FIG. 15 shows a palletless rack-type parking system with stacker cranes according to a third embodiment of the present invention.

According to the third embodiment, the palletless rack-type parking system is constructed so that a transporting fork bars 92 of a transporting fork 90 and a storage fork bars 80 is contrary to those of the second embodiment. That is, a height "a" of the storage fork bar 80 is set to be less than a height "b" of a transporting fork bar 92 by at least operational allowance "$g_1$" or "$g_2$". In addition, a lower projection tap 81 is provided at the lower surface of the storage fork bar 80 with a predetermined height "$C_1$", and the storage fork bars 80 are mounted to the support beam 13 of the rack 10 through the lower projection taps 81.

A height "$C_1$" of the lower projection tap 81 of the storage fork bar 80 is determined to be larger than a sum of the upper and lower allowances "$g_1$" and "$g_2$" which are required to enable the transporting fork 90 to smoothly load or unload a vehicle C onto or from the storage fork bars 80. The operation of the parking system is performed in a manner similar to that of the second embodiment, and further explanation is thus not deemed necessary.

As described above, according to the present invention, a palletless rack-type parking system enables a transporting fork to be moved upward or downward within a minimum allowance that a vehicle is not interfered with transporting fork bars or storage fork bars of the transporting fork are horizontally alternated with the storage fork bars, when the transporting fork completely approaches the storage fork bar in a horizontal direction, thereby loading the vehicle onto or unloading it from the storage fork bars. Therefore, the parking system quickly loads or unloads vehicles into or from parking spaces of racks.

In addition, the transporting fork directly supports the vehicle on its transporting fork bars when loading or unloading the vehicle onto or from the storage fork bars of the rack. It needs not a separate pallet.

Therefore, the present invention has advantages in that quick and precise loading or unloading of vehicles into or from parking spaces can be accomplished and the operational reliability is improved, considerably.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A palletless rack-type parking system with a stacker crane, comprising:

a plurality of multistory racks each having a plurality of parking spaces in a lattice form and arranged on a support surface to be spaced apart from each another at a regular interval to form vertical spaces between them;

a plurality of storage fork bars each including a first projection tab projected from a predetermined portion of a lower surface thereof to have a predetermined height and horizontally mounted on an upper surface of a first support beam in a regular interval through the first projection tap to cross the support beam in a right angle, at least one end of which is projected longer from the support beam of the rack in a cantilever beam form;

a transporting fork including a plurality of transporting fork bars with a second projection tap projected from a predetermined portion of a lower surface thereof to have a predetermined height, in which the transporting fork bar is not higher than that of the storage fork bar, and arranged in a regular interval in parallel to each another to be alternately positioned between the storage fork bars and a second support beam arranged to cross the storage fork bar in a right angle and for supporting the second projecting tap facing its lower surface; and a stacker crane installed in each vertical space between two neighboring racks and operable in more than two-axial directions of leftward, rightward, upward and downward with the transporting fork being mounted thereon, in which the transporting fork laterally approaches the storage fork bars and the transporting fork bars enter into, moves up and down and retreats from the storage fork with being alternately overlapped between the storage fork bars.

2. The palletless rack-type parking system according to claim 1, wherein:

the upper surface of the transporting fork bar is positioned at a level higher or lower than upper surface of the storage fork bar by a predetermined allowance to avoid any interference with a vehicle or the storage fork bar, when the transporting fork laterally approaches or withdraws from the storage fork bars.

3. The palletless rack-type parking system according to claim 1, wherein:

a height of the storage fork bar is equal to that of the transporting fork bar, and a height of the first projection tap is equal to that of the second lower projecting tap.

4. The palletless rack-type parking system according to claim 2, wherein:

the heights of the first and second lower projection taps are determined to be larger than at least level kept between the upper surfaces of the transporting fork bar and the storage fork bar, when the transporting fork laterally approaches or withdraws from the storage fork bar.

5. The palletless rack-type parking system according to claim 1, wherein:

the first support beam supporting the storage fork bars is positioned to be leaned toward a direction opposite to a transporting fork approaching side from the middle portion of the storage fork bar.

6. The palletless rack-type parking system according to claim 5, wherein:

an eccentric amount of the first support beam is determined to be larger than at least width of the second support beam of the transporting fork.

7. The palletless rack-type parking system according to claim 1, wherein:

the storage fork bars and the transporting fork bars are sectioned into a front fork bar group and a rear fork bar group, respectively, said front fork bar group and said rear fork bar group being spaced apart in an interval from each other to respectively support front wheels and rear wheels of a vehicle.

8. The palletless rack-type parking system according to claim 7, wherein:

the rear fork bar groups have a width larger than a width of the front fork bar groups.

9. The palletless rack-type parking system according to claim 8, wherein:

the front fork bar groups have different heights from each other to correspond to the front wheels of the vehicle, the entire shapes of which are formed as an arc cross section.

10. The palletless rack-type parking system according to claim 1, wherein:

the storage fork bar is provided with two first lower projection taps spaced away in an interval from each other and mounted through the two first lower projection taps to the upper surfaces of two first horizontal support beams.

11. The palletless rack-type parking system according to claim 1, wherein:

an edge rack at the outmost side of racks includes a first support beam for supporting the storage fork bars, in which the first support beam is mounted at its both ends to each of two short horizontal support beam to be leaned inward toward an outmost post of the edge rack opposite to the transporting fork approaching side, the storage fork bars being formed as a cantilever beam structure to allow the projection of the storage fork bars for the approaching of the transporting fork thereto at the transporting fork approaching side.

12. The palletless rack-type parking system according to claim 1, wherein:

the storage fork bars are provided in parking spaces of intermediate racks between the outmost side racks, both ends which are projected from the center of the first support beam toward the transporting fork approaching side by at least ½ of a sum of a length of the storage fork bar and widths of the first and second support beams.

13. The palletless rack-type parking system according to claim 1, wherein:

any one of the parking spaces formed at the foremost position of one edge rack is designated as a standby space for entering/delivering vehicles to be communicated with an exit/entrance of a housing covering the racks.

14. The palletless rack-type parking system according to claim 13, wherein:

a floor is laid on an area free of the storage fork bar in the standby space to be flush with the storage fork bar.

15. A palletless rack-type parking system with a stacker crane, comprising:

a plurality of multistory racks each having a plurality of parking spaces in a lattice form and arranged on a support surface to be spaced apart from each another;

a plurality of storage fork bars mounted on a horizontal support beam on a long edge of the rack to be spaced away in an interval from each another crossing it in a right angle, at least one end of which are projected from the horizontal support beam in a cantilever beam form;

a transporting fork including a plurality of transporting fork bars having a height less than the storage fork bar and arranged in a regular interval to be in parallel to the storage fork bars, in which the transporting fork bar includes a second projection tap projected from one portion of the lower surface thereof to have a predetermined height, its total height becoming larger than that of the storage fork bar and a second support beam arranged to cross the storage fork bar in a right angle and for supporting the second projecting tap facing its lower surface; and a stacker crane installed in each vertical space between two neighboring racks and operable in more than two-axial directions of leftward, rightward, upward and downward with the transporting fork being mounted thereon, in which the transporting fork laterally approaches the storage fork bars and the transporting fork bars enter into, moves up and down and retreats from the storage fork with being alternately overlapped between the storage fork bars.

16. The palletless rack-type parking system according to claim 15, wherein:

the transporting fork bars are sectioned into a front fork bar group and a rear fork bar group arranged to be spaced away in an interval from each other and for separately supporting front wheels and rear wheels of a vehicle.

17. The palletless rack-type parking system according to claim 6, wherein:

a width of the rear storage and transporting fork bars is larger than that of the front storage and transporting fork bars.

18. The palletless rack-type parking system according to claim 17, wherein:

the front storage and transporting fork bars have different heights from each other to correspond to the front wheel of the vehicle, the entire shapes of which are formed as an arc cross section.

19. The palletless rack-type parking system according to claim 18, wherein:

the front storage fork bars have the same height to each another and respectively includes a connecting tap mounted in a different height from each another on its lower portion to be increased from the center toward both outsides, the entire shape of which is formed as an arc cross-section.

20. A palletless rack-type parking system with a stacker crane, comprising:

a plurality of racks each having a plurality of parking spaces in a lattice form and arranged on a support surface to be spaced apart from each another;

a plurality of storage fork bars including a first projection tap on the lower surface thereof and mounted through the first projection tap on a horizontal support beam to be spaced away in an interval from each another crossing it in a right angle, at least one end of which are projected from the horizontal support beam in a cantilever beam form;

a transporting fork including a plurality of transporting fork bars having a height less than that of the storage fork bar plus the first projection tap and larger than that of the storage fork bar and arranged in a regular interval to be in parallel to the storage fork bars and a second support beam arranged to cross the storage fork bar in a right angle and for supporting the second projecting tap facing its lower surface; and, a stacker crane installed in each vertical space between two neighboring racks and operable in more than two-axial directions of leftward, rightward, upward and downward with the transporting fork being mounted thereon, in which the transporting fork laterally approaches the storage fork bars and the transporting fork bars enter into, moves up and down and retreats from the storage fork with being alternately overlapped between the storage fork bars.

21. The palletless rack-type parking system according to claim 20, wherein:

the transporting and storage fork bars are sectioned into front fork bar groups and rear fork bar groups arranged to be spaced away in an interval from each other and for separately supporting front wheels and rear wheels of a vehicle.

22. The palletless rack-type parking system according to claim 21, wherein:

a width of the rear storage and transporting fork bars is larger than that of the front storage and transporting fork bars.

23. The palletless rack-type parking system according to claim 22, wherein:

the front storage and transporting fork bars have different heights from each other to correspond to the front wheel of the vehicle, the entire shapes of which are formed as an arc cross section.

* * * * *